US007241199B2

(12) United States Patent
Huang

(10) Patent No.: US 7,241,199 B2
(45) Date of Patent: Jul. 10, 2007

(54) SEAMLESS BRASSIERE

(75) Inventor: Huei-Rong Huang, 29, Lane 187, Chiung-Lin S. Road, Hsin-Chuang City (TW) 242-63 Taipei

(73) Assignee: Huei-Rong Huang (TW)

( * ) Notice: Subject to any disclaimer, the term of this patent is extended or adjusted under 35 U.S.C. 154(b) by 0 days.

(21) Appl. No.: 11/016,561

(22) Filed: Dec. 20, 2004

(65) Prior Publication Data

US 2006/0135038 A1 Jun. 22, 2006

(51) Int. Cl.
*A41C 3/12* (2006.01)
*A41C 3/14* (2006.01)

(52) U.S. Cl. ..... 450/39; 450/41; 450/54; 450/57

(58) Field of Classification Search ..... 450/39–45, 450/54–57, 51, 52; 2/243.1, 267, 268; 156/245, 156/73.1, 60, 73.3, 73.4, 88, 1; 264/152–155, 264/157, 257, 258, 291, 292, 294, 320, 321, 264/163, 145, 148, 160
See application file for complete search history.

(56) References Cited

U.S. PATENT DOCUMENTS 3,202,565 A * 8/1965 Loftin ..... 428/175
6,837,771 B2 * 1/2005 Falla ..... 450/39
6,966,815 B2 * 11/2005 Weinerth ..... 450/41

FOREIGN PATENT DOCUMENTS

WO WO 01/08516 * 2/2001 ..... 450/39
WO WO 02/07548 * 1/2002 ..... 450/39

* cited by examiner

*Primary Examiner*—Gloria M. Hale
(74) *Attorney, Agent, or Firm*—Venable LLP; Raymond J. Ho

(57) ABSTRACT

The present invention relates to a seamless brassiere. The brassiere has an outer shield with pattern, two breast cups, two back band, an inner lining corresponding to the outer shield, two elastic non-woven inner pads, two steel wires, a fastener, and two shoulder straps. The steel wire is sewn to a bottom edge of the lining pad. With glue smeared onto the outer shield, lining pads, and inner lining, the brassiere can be assembled with fastener set and shoulder straps by heat pressing in the mold, thereby forming the brassiere that is seamless, tight, and ventilative.

11 Claims, 2 Drawing Sheets

SEAMLESS BRASSIERE

BACKGROUND OF THE INVENTION

1. Field of the Invention

The present invention relates to a seamless brassiere, which particularly relates to the whole comprising a non-woven lining pad to form a fitted breast cup shape with good comfortable ventilation. Via heat press forming combines parts to a seamless, tight compacted, and lightweight brassiere.

2. Description of the Related Art

The conventional manufacturing methods of brassiere, which are mostly sewing continuously to combine various parts into one, are generally complicated and therefore difficult to achieve quality control. The conventional brassieres can be deformed and threadbare after just normal wear and wash. Although the conventional brassiere design with steel wires has been popular in the market because the steel wires can be used to support breasts, they are generally sewn onto the brassiere with a line of stitches that cause rugged surfaces. Additionally, the shape of a conventional breast cup is configured by a polyurethane foam pad (PU) through gluing and heating. However, such polyurethane foam pad, after undergoing gluing and heating, can be hardened, heavy, and lack proper ventilation.

SUMMARY OF THE INVENTION

In view of aforementioned drawbacks in the conventional brassiere, the present invention provides a seamless brassiere with steel wires that can be seamlessly combined with a pad, lining and shield to thin out the breast cup, thereby reducing manufacturing time and costs. Additionally, using non-woven fabric and polyethylene (e.g., Density Polyethylene or DPE) in a heat sealing process, a ventilative and lightweight brassiere can be constructed.

The seamless brassiere of the present invention comprises an outer shield, which further comprises two breast cups and back bands, with an appropriate pattern, a inner lining corresponding to the outer shield, two lining pads of heat-forming elastic nonwoven fabric with DPE sealing, and two steel wires with fabric covers. The seamless brassiere also comprises a fastener set and two shoulder straps for wearing.

The outer shield and the inner lining of the seamless brassier are each made from elastic fabric through handmade cutting or machine made in a mold. The pattern of the outer shield can be constructed through weaving or stitching. The pattern can also be made through a patterned knit which is heat-pressed with the outer shield. The lining pad of elastic non-woven fabric is lighter and more ventilative than the PU.

Sewing the fabric-covered steel wires on the under edges of the lining pads of the outer shield, the seamless brassiere is gluing and heat-pressing assembled from the outer shield, the lining pads with the steel wires, the inner lining, the fastener set, and the shoulder straps.

DETAILED DESCRIPTION OF THE PREFERRED EMBODIMENTS

In the following description, please refer to the drawings.

Figure 1:
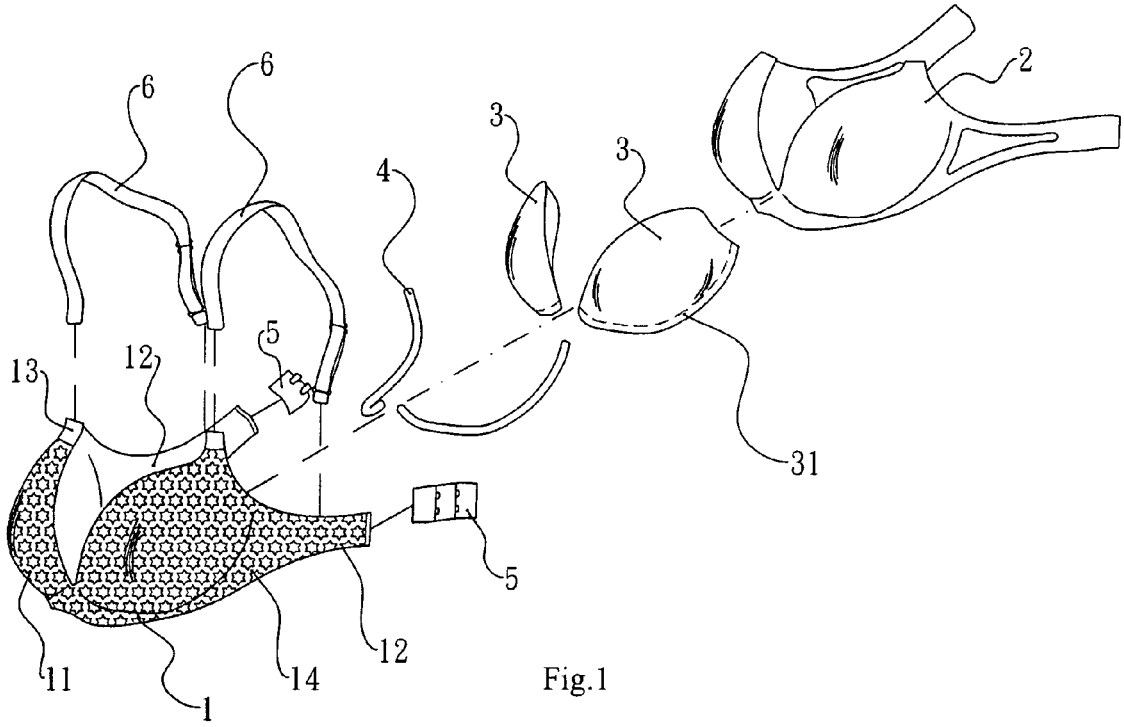
FIG. 1 is a diagram of the exploded perspective view of the present invention.
Figure 2:
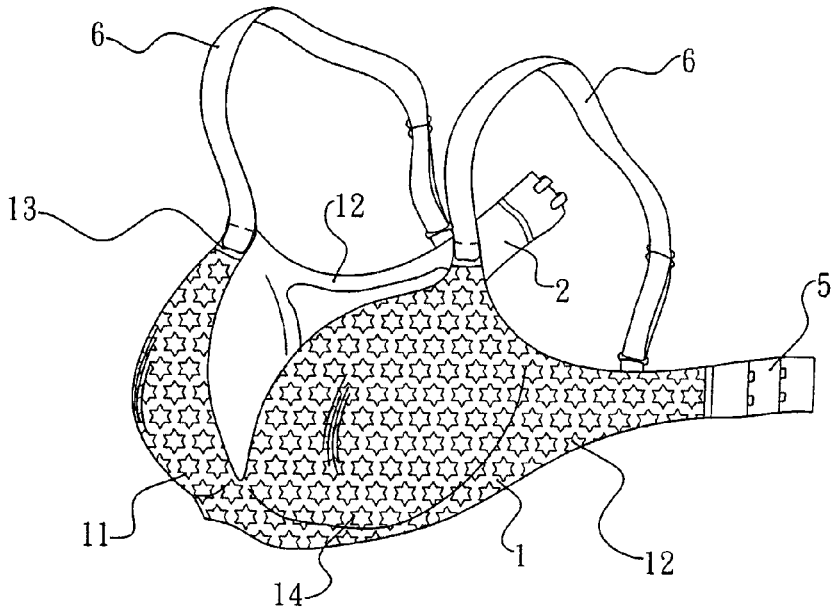
FIG. 2 is a diagram of the perspective view of the present invention.

As shown in FIG. 1 and FIG. 2, the seamless brassiere of the present invention comprises an outer shield 1, an inner lining 2, and two lining pads 3. The outer shield 1 is one whole elastic fabric cut by hand or mold, and comprises two breast cups 11, two back bands 12, two extended shoulder portions 13, and a pattern layer 14. The seamless brassiere further comprises two steel wires 4, a fastener set 5, and two shoulder straps 6 that connect to the back bands 12 and the shoulder portions 13.

The size and shape of the outer shield 1 are corresponding to the inner lining 2. The lining pads 3 are made of nonwoven fabric with DPE heat-sealing. On the bottom edge of the lining pad 3 is a cove 31 fit for the steel wire 4. The nonwoven fabric made of elastic fiber is lighter and more ventilative than PU utilized in prior arts, and with DEP heat-pressed sealing forms a fit cup in three-dimensional shape. The pattern layer 14 can be made of weaving, drawing, needlework, or a pattern knit heat-pressed combination with the outer shield 1.

Figure 3:
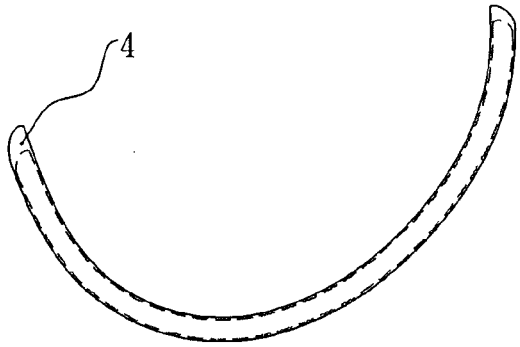
FIG. 3 is a diagram of the perspective view of the steel wire of the present invention.
Figure 4:
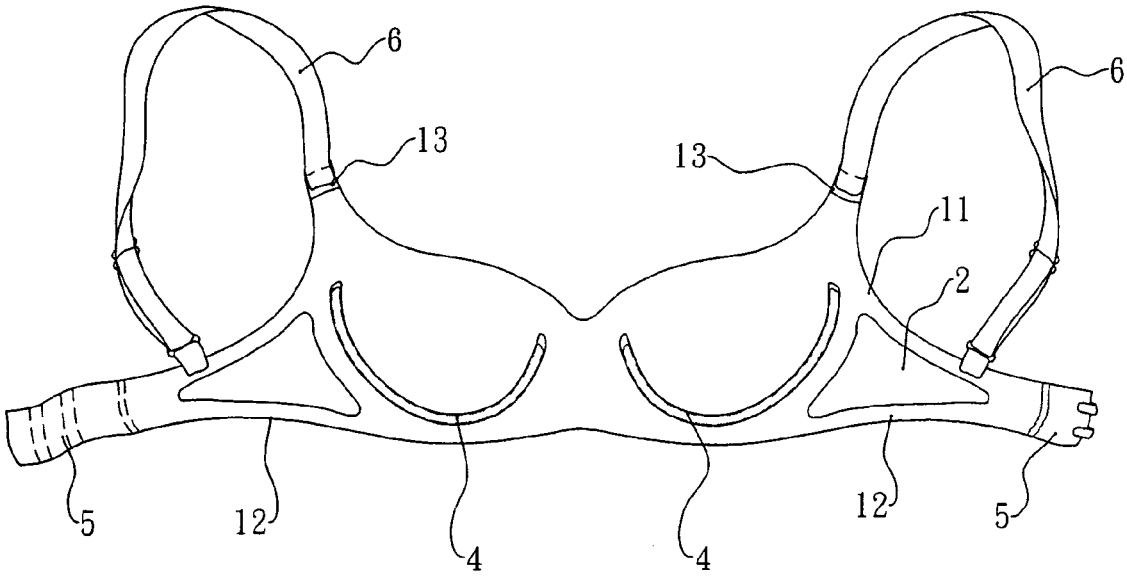
FIG. 4 is a diagram of the rear view of the present invention.

To assemble the seamless brassiere, the steel wires 4, as shown in FIG. 3, are sewed in the bottom edges of the lining pads 3, i.e. the coves 31, first. Then the outer shield 1, the lining pads 3 sewed the steel wires in, and the inner lining 2 are glued and heat pressed to combine together with the fastener set 5 and the shoulder straps 6, and to form a seamless brassiere. The rear view of the seamless brassiere of the present invention is shown as the FIG. 4.

The foregoing describing of the preferred embodiment of the invention is for the purposes of illustration and description. It is not intended to exhaustive or to limit the invention to the precise from disclosed. Many other possible modifications and variations can be made without departing from the scope of the present invention, which following claims are depended.

What is claimed is:

1. A seamless brassiere comprising:

an outer shield, which comprises two breast cups and two extended back bands;

an inner lining corresponding to the outer shield in size and shape;

two lining pads, which are made of elastic non-woven fabric;

two steel wires; and a fastener set connected to the back bands, wherein each of said steel wires is sewn into a bottom edge of each of said lining pads, and said outer shield, said lining pads, and said inner lining are smeared with glue and heat-pressed to seamlessly combine with said fastener set at the end of the back bands to form the seamless brassiere.

2. The seamless brassiere according to claim 1, wherein said outer shield is made of a patterned layer.

3. The seamless brassiere according to claim 2, wherein said patterned layer is constructed by weaving, or stitching.

4. The seamless brassiere according to claim 2, wherein said pattern layer is made of a pattern knit and heat-pressed combination with the outer shield.

5. The seamless brassiere according to claim 4, wherein said pattern knit is made by stitching.

6. The seamless brassiere according to claim 1, wherein said lining pad is heat-pressed to seal with polyethylene and to shape.

7. The seamless brassiere according to claim 1, which further comprises two shoulder straps.

8. The seamless brassiere according to claim 1, wherein said fastener set is connected to said two back bands.

9. The seamless brassiere according to claim 8, wherein said fastener set comprises a hook and a loop.

10. The seamless brassiere according to claim 1, wherein a bottom edge of said lining pad has a cove to accommodate said steel wire.

11. The seamless brassiere according to claim 1, wherein said steel wire is encased by a fabric cover.

* * * * *